US009169819B2

(12) United States Patent
Hartmann et al.

(10) Patent No.: US 9,169,819 B2
(45) Date of Patent: Oct. 27, 2015

(54) METHOD FOR ENGAGING A STARTING PINION OF A STARTING DEVICE WITH A RING GEAR OF AN INTERNAL COMBUSTION ENGINE

(75) Inventors: Sven Hartmann, Stuttgart (DE); Juergen Gross, Stuttgart (DE)

(73) Assignee: ROBERT BOSCH GMBH, Stuttgart (DE)

( * ) Notice: Subject to any disclaimer, the term of this patent is extended or adjusted under 35 U.S.C. 154(b) by 1135 days.

(21) Appl. No.: 13/201,709

(22) PCT Filed: Jul. 29, 2009

(86) PCT No.: PCT/EP2009/059797

§ 371 (c)(1), (2), (4) Date: Oct. 19, 2011

(87) PCT Pub. No.: WO2010/012764

PCT Pub. Date: Feb. 4, 2010

(65) Prior Publication Data

US 2012/0024253 A1 Feb. 2, 2012

(30) Foreign Application Priority Data

Aug. 1, 2008 (DE) ..... 10 2008 040 945

(51) Int. Cl.
*F02N 11/08* (2006.01)
*F02N 15/02* (2006.01)
(Continued)

(52) U.S. Cl.
CPC ..... *F02N 11/0855* (2013.01); *F02N 11/0844* (2013.01); *F02N 15/022* (2013.01);
(Continued)

(58) Field of Classification Search
CPC . F02N 11/0844; F02N 11/0855; F02N 15/04; F02N 2200/22; F02N 2250/04; F02N 2300/2006; F02N 2300/2008; F02N 15/022; F02N 15/046; F02N 15/063; F02N 15/067; F02N 2200/022; Y02T 10/48
USPC ..... 123/179.25, 179.4, 179.3, 185.13, 123/406.58, 406.61, 406.63, 436, 631; 290/38 E, 38 R; 74/6, 7 R
See application file for complete search history.

(56) References Cited

U.S. PATENT DOCUMENTS 2,847,985 A * 8/1958 Strang ..... 123/179.1
2,944,427 A * 7/1960 Ulm et al. ..... 74/7 R
(Continued)

FOREIGN PATENT DOCUMENTS

DE 197 02 932 7/1998
DE 10 2004 017496 2/2005
(Continued)

OTHER PUBLICATIONS

Newton's Three Laws of Motion phys.utk.edu.*
(Continued)

*Primary Examiner* — Erick Solis
*Assistant Examiner* — Carl Staubach
(74) *Attorney, Agent, or Firm* — Kenyon & Kenyon LLP

(57) ABSTRACT

A method is described for engaging a starting pinion of a starting device with a ring gear of an internal combustion engine, the starting pinion having a peripheral speed and the ring gear having a peripheral speed, the starting pinion being pushed forward axially along its axis of rotation, the starting pinion making contact with the ring gear at a peripheral speed which is lower than the peripheral speed of the ring gear.

16 Claims, 8 Drawing Sheets

(51) Int. Cl.
*F02N 15/04* (2006.01)
*F02N 15/06* (2006.01)

(52) U.S. Cl.
CPC ..... *F02N 15/046* (2013.01); *F02N 15/063* (2013.01); *F02N 15/067* (2013.01); *F02N 2200/022* (2013.01); *F02N 2200/041* (2013.01)

(56) References Cited

U.S. PATENT DOCUMENTS

| | | | | |
|---|---|---|---|---|
| 2,969,052 | A * | 1/1961 | Randol et al. | 477/99 |
| 6,981,481 | B2 * | 1/2006 | Kojima et al. | 123/179.3 |
| 7,275,509 | B2 * | 10/2007 | Kassner | 123/179.25 |
| 7,665,438 | B2 * | 2/2010 | Hirning et al. | 123/179.3 |
| 7,996,135 | B2 * | 8/2011 | Ishii et al. | 701/54 |
| 8,095,298 | B2 * | 1/2012 | Nakamura et al. | 701/112 |
| 8,141,534 | B2 * | 3/2012 | Liu et al. | 123/179.4 |
| 8,534,145 | B2 * | 9/2013 | Niimi et al. | 74/7 R |
| 8,561,588 | B2 * | 10/2013 | Reynolds et al. | 123/179.3 |
| 8,631,778 | B2 * | 1/2014 | Moriya et al. | 123/179.4 |
| 8,793,061 | B2 * | 7/2014 | Okumoto et al. | 701/113 |
| 2007/0084429 | A1 * | 4/2007 | Taki et al. | 123/179.4 |
| 2009/0020091 | A1 * | 1/2009 | Botzenhard et al. | 123/179.3 |
| 2010/0059007 | A1 * | 3/2010 | Senda et al. | 123/179.4 |
| 2010/0180849 | A1 * | 7/2010 | Senda et al. | 123/179.4 |
| 2010/0282199 | A1 * | 11/2010 | Heyers et al. | 123/179.3 |
| 2011/0056450 | A1 * | 3/2011 | Notani | 123/179.4 |

FOREIGN PATENT DOCUMENTS

| | | |
|---|---|---|
| DE | 10 2005 004326 | 2/2006 |
| DE | 10 2005 021227 | 11/2006 |
| DE | 10 2005 049092 | 4/2007 |
| DE | 10 2006 011644 | 9/2007 |
| WO | 2008/131983 | 11/2008 |
| WO | 2009/083370 | 7/2009 |
| WO | 2009/083477 | 7/2009 |

OTHER PUBLICATIONS

Inelastic Collisions phy-astr.gsu.edu.*
Conservation Laws phy-astr.gsu.edu.*

* cited by examiner

METHOD FOR ENGAGING A STARTING PINION OF A STARTING DEVICE WITH A RING GEAR OF AN INTERNAL COMBUSTION ENGINE

FIELD OF THE INVENTION

The present invention relates to a method for engaging a starting pinion of a starting device with a ring gear of an internal combustion engine.

BACKGROUND INFORMATION

A method is discussed in unexamined Patent Application DE 2006 011 644 A1 of how to dynamically engage two moving gear wheels of a starting device and an internal combustion engine (pinion and ring gear). This unexamined Patent Application discusses the case where the pinion in the so-called slow-down stage of the internal combustion engine is to engage with the ring gear of the internal combustion engine. The subject matter of the method disclosed therein is that engagement of the pinion with the ring gear is to essentially take place with both gear parts having the same peripheral speed.

For this purpose it is provided that engaging the pinion with the ring gear of the starting device is achieved by achieving deliberately and through technical means that the starting pinion makes contact with the ring gear at a peripheral speed that is lower than the peripheral speed of the ring gear. This has the advantage that engagement of the pinion with the ring gear can take place in the same way as when conventionally engaging the pinion of a common starter with the ring gear. Under normal circumstances, the conventional engaging process causes relatively little wear, which is very much desired, in particular, in a vehicle having a start-stop system. In a vehicle having a start-stop system the number of starts is, for example, up to ten times higher than in vehicles having a conventional starting system. Against this backdrop, it is especially desirable to make low-wear engagement in a start-stop system possible.

SUMMARY OF THE INVENTION

The method according to the present invention having the features of the main claim has the advantage that when engaging a starting pinion with the ring gear of an internal combustion engine the speed ratios are such that they allow a relatively gentle, i.e., low-wear, engagement of the starting pinion with the ring gear.

In a variant of the exemplary embodiments and/or exemplary methods of the present invention it is provided that the peripheral speed of the ring gear is not equal to zero when the starting pinion makes contact with the ring gear at a peripheral speed. In particular in the case that the starting pinion is actively rotated for engaging, it is provided that the peripheral speed of the starting pinion is not equal to zero for the special, intended kinematic and kinetic ratios to be achieved.

The method is particularly reliable when the peripheral speeds of the ring gear and the starting pinion at their joint engagement point are oriented in the same direction. In the case that both the ring gear and the starting pinion are each designed to be externally toothed spur gears, for example, this means that they rotate in opposite directions.

With respect to the different peripheral speeds of the ring gear and the starting pinion, comprehensive tests have shown that special ratios should apply with regard to the peripheral speeds. Thus it is provided that the peripheral speed of the ring gear at the moment of initial contact with the starting pinion or the contact of the starting pinion with the ring gear is higher at most by a value formed by the product of 5 meters per second per millimeter and the module of the ring gear in millimeters and is at least higher than the peripheral speed of the starting pinion. The method may be made even more reliable in that the starting device has a pinion shaft which drives the starting pinion, a spring force of a spring element acting between the starting pinion and the pinion shaft in the direction of the starting pinion's axis of rotation, the spring element being compressed due to the contact between the starting pinion and the ring gear. The system is made more reliable not only due to the elastic properties, but also, simultaneously, due to the damping processes associated with it, which arise from the friction between the spring and its outer support or with some flow damping devices, for example.

Furthermore, it is important for the method that the starting pinion is pushed forward to the ring gear in time and also reaches as high a peripheral speed as intended. It is thus important that a switching criterion is recognized by a control unit and the starting pinion is then pushed forward toward the ring gear in one step and is set into rotation in another step, the peripheral speed prevailing at the starting pinion when reaching the ring gear being lower than the peripheral speed of the ring gear. These measures may ensure that the pinion comes into contact with the ring gear at the right time and has a suitable property. Which switching criterion is chosen in this context is at first irrelevant. It is also irrelevant which control unit recognizes the switching criterion.

The switching criterion may thus be a signal that corresponds to an intention to switch off the internal combustion engine. The intention to switch off the internal combustion engine may, for example, result from the fact that the vehicle speed is zero, for example, and/or the drivetrain is open or the vehicle speed is below a low speed threshold, for example, <7 km/h, for example. A further switching criterion may be a signal, for example, which corresponds to a speed property of the ring gear of the internal combustion engine. In this case, a speed property of the ring gear could, for example, be the angular velocity of the ring gear or the change in the angular velocity of the ring gear, for example below a specific speed threshold, from which an approaching standstill of the internal combustion engine may be assumed. A property of this type could indicate that the internal combustion engine should be switched off (e.g., automatic momentum utilization). Here, it is provided that a point in time at which the starting device is activated is calculated based on the switching criterion. For example, it could be defined that, in the case that the internal combustion engine reaches a speed of below 600 rpm/min, the starting device is activated (starting pinion rotates, starting pinion is pushed forward) in order to bring the starting pinion in contact with the ring gear having the suitable property at the appropriate point in time.

With respect to the method it is provided in particular that the starting pinion is first set into rotation in one step and then pushed forward toward the ring gear in one step.

One exemplary embodiment of the method according to the present invention is illustrated in the drawings.

DETAILED DESCRIPTION

Figure 1:
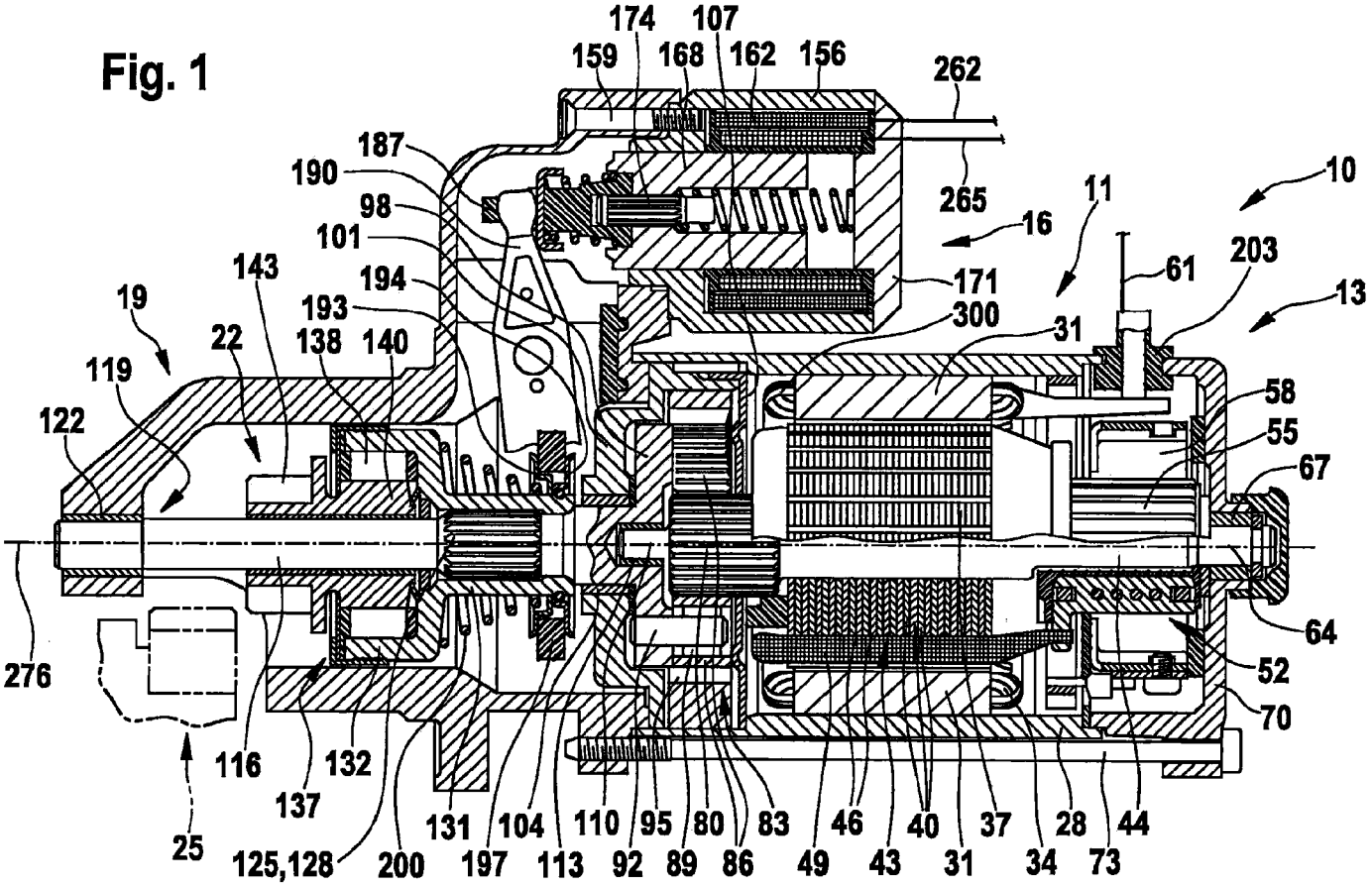
FIG. 1 shows a starting device and sections of an internal combustion engine including ring gear.

FIG. 1 shows a longitudinal section of an electric machine 10 (starting device). This electric machine 10 has an electric motor 13 (starter motor), for example, and a thrust device 16. Electric motor 13 and thrust device 16 are fastened to one joint drive end shield 19. Electric motor 13 has, for example, the function of driving a starting pinion 22, if it is engaged with ring gear 25 of the internal combustion engine (not shown in the drawing).

As housing 11, electric motor 13 has pole tube 28, which has pole shoes 31 in its inner periphery around each of which a field coil 300, which is part of a field winding 34, is wound. Pole shoes 31, in turn, surround an armature 37 that has an armature pack 43 constructed from plates 40, and an armature winding 49 situated in grooves 46. Armature pack 43 is pressed onto a driving shaft 44. Furthermore, a commutator 52, which is constructed from individual commutator plates 55 among other things, is situated on the end of driving shaft 44 facing away from starting pinion 22. Commutator plates 55 are electrically connected to armature winding 49 in a known way so that armature 37 starts rotating in pole tube 28 when commutator plates 55 are supplied with current via carbon brushes 58. In the ON state, a power supply unit 61 supplies both carbon brushes 58 and field winding 34 with power. Driving shaft 44 is supported on the commutator side via a shaft journal 64 in a sliding bearing 67, which in turn is kept in place in a commutator bearing cap 70. Commutator bearing cap 70 is in turn fastened to drive end shield 19 with the aid of tie-bolts 73, which are distributed over the periphery of pole tube 28 (for example, two, three or four screws). Pole tube 28 is supported by drive end shield 19 and commutator bearing cap 70 by pole tube 28.

A so-called sun gear 80, which is part of a planetary-gear set 83, is situated next to armature 37 in the driving direction. Sun gear 80 is surrounded by multiple planetary gears 86, usually three planetary gears 86, which are supported on axle journal 92 with the aid of rolling bearings 89. Planetary gears 86 move in an internal ring gear 95, which is installed in pole tube 28. A carrier 98, in which axle journals 92 are accommodated, is situated next to planetary gears 86 in the direction of the power take-off side. Carrier 98 is in turn located in an intermediate bearing 101 and a sliding bearing 104 situated therein. Intermediate bearing 101 is pot-shaped in such a way that it accommodates both carrier 98 and planetary gears 86. Furthermore, internal ring gear 95, which is finally closed against armature 37 by a cap 107, is situated in pot-shaped intermediate bearing 101. The outer periphery of intermediate bearing 101 is also supported by the inside of pole tube 28. Armature 37 has a further shaft journal 110, which is also accommodated in a sliding bearing 113 on the end of driving shaft 44 facing away from commutator 52. Sliding bearing 113 is in turn accommodated in a central bore hole of carrier 98. Carrier 98 is connected to an output shaft 116 to form one piece. End 119 of this output shaft facing away from intermediate bearing 101 is supported by a further bearing 122, which is fastened in drive end shield 19. Output shaft 116 is divided up into different sections: The section which is situated in sliding bearing 104 of intermediate bearing 101 is followed by a section having a so-called spur toothing 125 (internal toothing), which is part of a so-called shaft/hub connection. This shaft/hub connection 128 makes axial linear sliding of a driver 131 possible. This driver 131 is a sleeve-like journal which is connected to a pot-shaped outer ring 132 of overrunning clutch 137, for example, to form one piece. This overrunning clutch 137 (locking gear) further includes inner ring 140, which is radially situated within outer ring 132. Clamp bodies 138 are situated between inner ring 140 and outer ring 132. In cooperation with the inner and outer ring, these clamp bodies 138 prevent relative rotation between the outer ring and the inner ring in a second direction. In other words: Overrunning clutch 137 enables a peripheral relative movement between inner ring 140 and outer ring 134 in only one direction. In this exemplary embodiment inner ring 140 is designed to form one piece with starting pinion 22 and its toothing 143.

The pinion engaging mechanism is explained in the following. Thrust device 16 has a housing 156 which is fastened to drive end shield 19 with the aid of multiple fastening elements 159 (screws). A winding 162 for pulling in is situated in thrust device 16. Winding 162 for pulling in creates an electromagnetic field, which flows through different components, when switched on. Among other things, this magnetic field has an effect on a linearly movable armature, here referred to as stroker 168, and a core plate 171, here cap-like, if applicable. Stroker 168 carries a sliding rod 174 which is moved to the right when stroker 168 is pulled in linearly.

Thrust device 16 or stroker 168 has the function of moving a lever 190, which is rotatably situated in drive end shield 19, using a traction element 187. This lever 190, usually implemented as a fork lever, grips a driver ring 197 which is located between two discs 193 and 194 using two "tines" or fork arms (not shown here) situated on its outer periphery, in order to move driver ring 197 toward overrunning clutch 137 against the resistance of spring 200, thus making starting pinion 22 engage with ring gear 25.

As an alternative, electric motor 13 could be excited by a permanent magnet. In this case, pole tube 28 has permanent magnets, which provide the respective opposing field to armature 37, in its inner periphery instead of pole shoes 31, each enclosed by a field coil 300.

Figure 2:
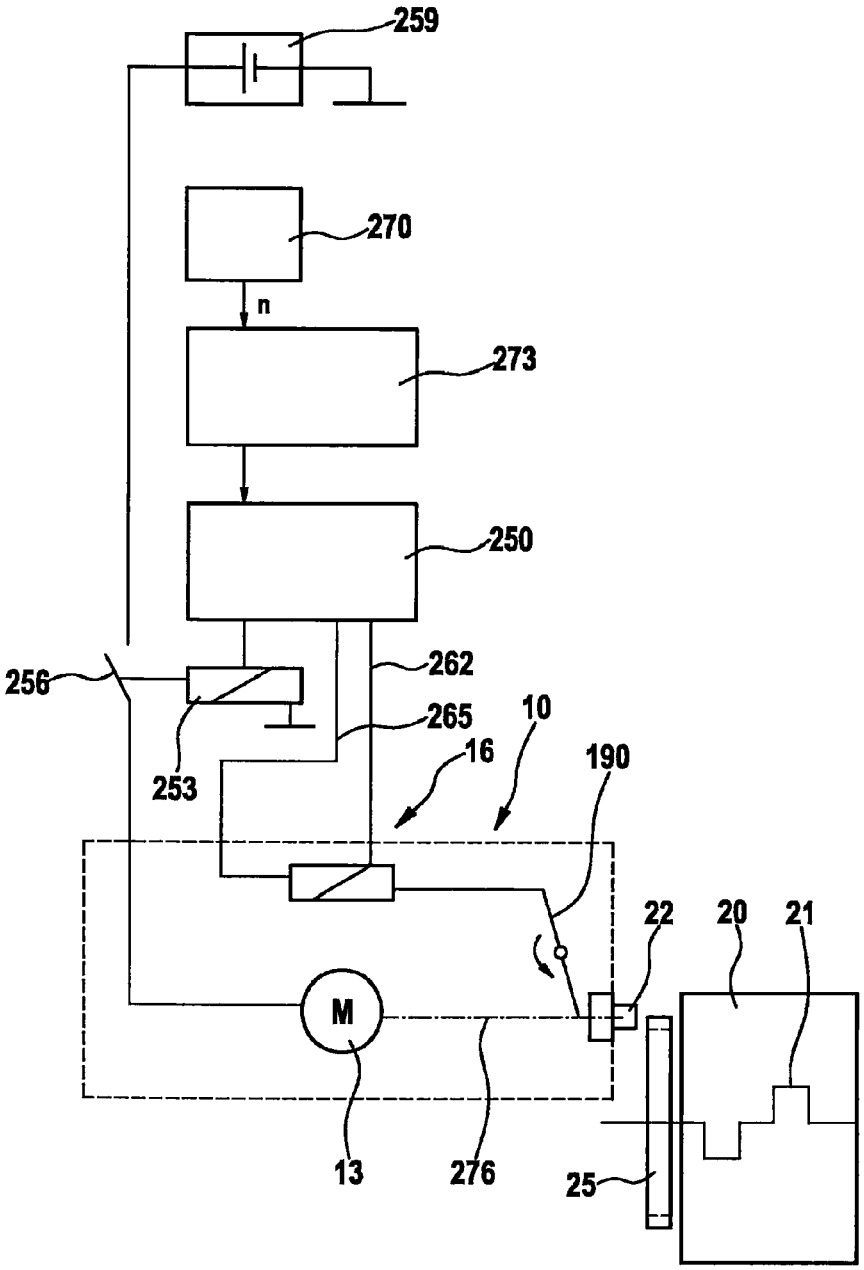
FIG. 2 shows a schematic view of the system including the internal combustion engine, starting device, and control units in a first exemplary embodiment.

FIG. 2 shows how starting device 10 is electrically connected to a starter control unit 250. This starter control unit 250 controls, for example, a switch 256, which is responsible for supplying power to starter motor 13, via an electrical solenoid 253 (relay). If this switch 256 is closed, positive electrical potential of a starter battery or a starter accumulator 259 is applied to starter motor 13. Subsequently, armature 37 starts rotating, starting pinion 22 starting to rotate as well. Furthermore, starter control unit 250 switches thrust device 16. For this purpose, winding 162 for pulling in is provided with power via two electrical lines 262 and 265. Subsequently, stroker 168, which moves traction element 187 and then lever 190, moves. Starting pinion 22 is thus pushed forward in the direction of driving shaft 116, axially in the direction of ring gear 25.

Figure 3:
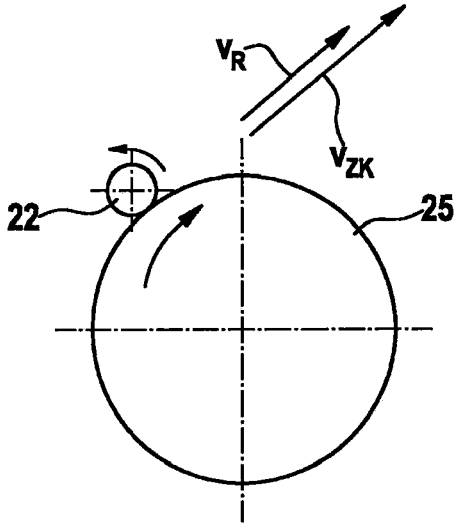
FIG. 3 shows a schematic illustration of the speed ratios at the point in time of the initial contact between the starting pinion and the ring gear.

The sequence is thus as follows according to the exemplary embodiment of FIG. 2: A speed sensor 270 transmits a signal to an engine control unit 273. This signal corresponds in this case to a speed property of ring gear 25 of internal combustion engine 20. It is irrelevant in this case whether speed sensor 270 transmits the speed of ring gear 25 or the speed of another component connected to ring gear 25. The speed of a camshaft of internal combustion engine 20 could also be used, for example. In the exemplary embodiment in FIG. 2, engine control unit 273 determines whether or not starter control unit 250 should be activated. If the speed property is such that starting pinion 22 is to be engaged with ring gear 25, engine control unit 273 activates in this case starter control unit 250 which includes starting starter motor 13 (activating solenoid 253, closing switch 256) and activating thrust device 16 by switching winding 162. Alternatives to this activation process exist and will be mentioned hereafter. According to the above-described method, a method is provided for engaging a starting pinion 22 of a starting device 10 in ring gear 25 of an internal combustion engine, starting pinion 22 having a peripheral speed $v_R$ due to a rotating starter motor 13 and ring gear 25 having a peripheral speed $v_{zK}$, starting pinion 22 being pushed forward axially along an axis of rotation 276. Starting pinion 22 makes contact with ring gear 25 at a peripheral speed $v_R$ which is lower than peripheral speed $v_{zK}$ of ring gear 25. FIG. 3 shows in an axial schematic view (axis of rotation of starting pinion 22 and ring gear 25) a front view of starting pinion 22 and ring gear 25 at the moment before starting pinion 22 makes contact with ring gear 25. Ring gear 25 is shown rotating to the right and starting pinion 22 rotating to the left. Ring gear 25 has a peripheral speed $v_{zK}$ on its outer periphery, i.e., here on the pitch diameter, and starting pinion 22 has a peripheral speed $v_R$ on its pitch diameter. As shown in the Figure, starting pinion 22 makes contact with ring gear 25 at a peripheral speed $V_R$, peripheral speed $v_R$ being lower than peripheral speed $v_{zK}$ of ring gear 25.

FIGS. 4*a* to 4*k* show highly schematically the sequence of the pinion engaging process. The diagrams in FIGS. 4*a* to 4*k* show in developed views the sequence of how the teeth of starting pinion 22 engage with the gaps of ring gear 25. This means that the periphery of gear wheels is shown to be linear in this case.

Figure 4A:
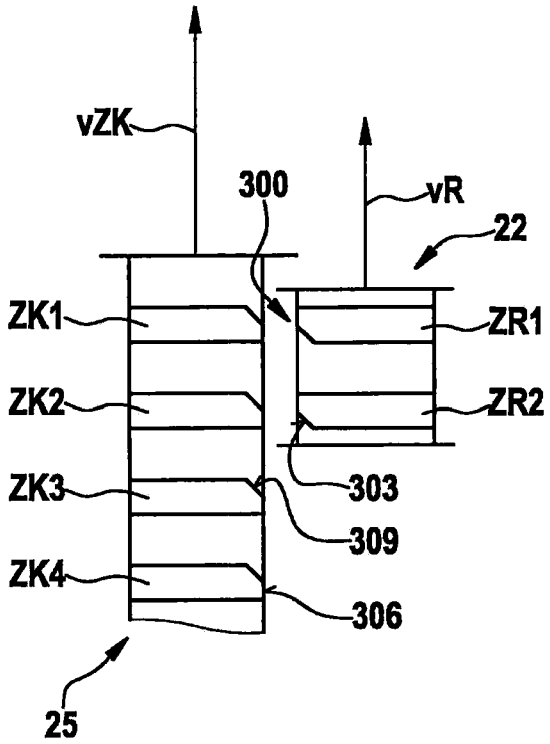
FIG. 4 shows the sequence of the method based on several snapshots of situations during the method sequence until the start of rotation.

FIG. 4*a* shows, for example, the situation of starting pinion 22 and ring gear 25 after starting pinion 22 has been set into rotation. Starting pinion 22 shows in the sectional illustration a tooth ZR1 and subsequently a tooth ZR2. These teeth ZR1 and ZR2 have a cant 303 on front side 300 facing ring gear 25; this cant 303 points toward the back side of the teeth. In this case the back side means that this cant transitions from front side 300 to the back side of the tooth, the back side of tooth ZR1 or ZR2 being oriented against the direction of rotation. Ring gear 25 also has a front side 306. Teeth ZK1, ZK2, ZK3 and ZK4, representing all teeth at the outer periphery of ring gear 25, have a cant 309 as well. In contrast to cants 303 of starting pinion 22, these cants 309 point toward the direction of rotation and thus of peripheral speed $v_{zK}$ based on front side 306. Cants 303 of starting pinion 22 and cants 309 of ring gear 25 are situated opposite each other or face each other. The different peripheral speeds of the pitch circles of starting pinion 22 and ring gear 25 are shown here with two differently sized arrows.

Figure 4B:
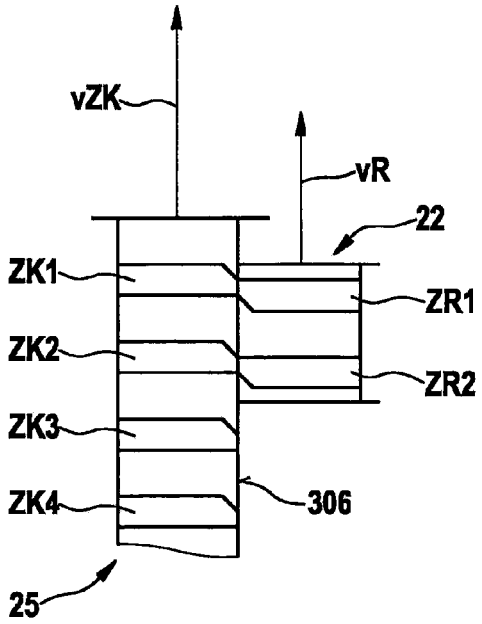
Figure 4C:
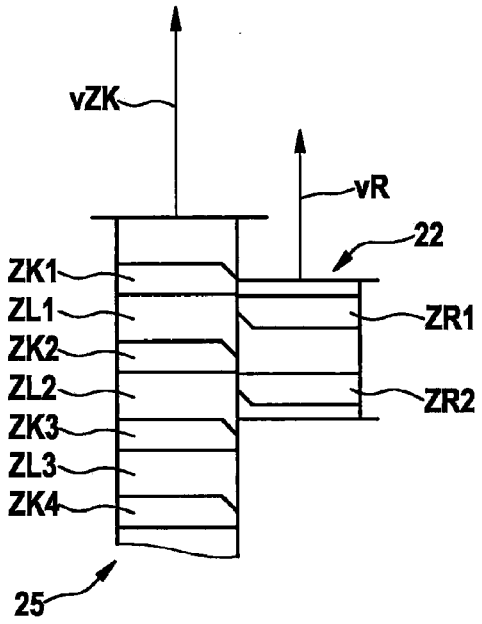
Figure 4D:
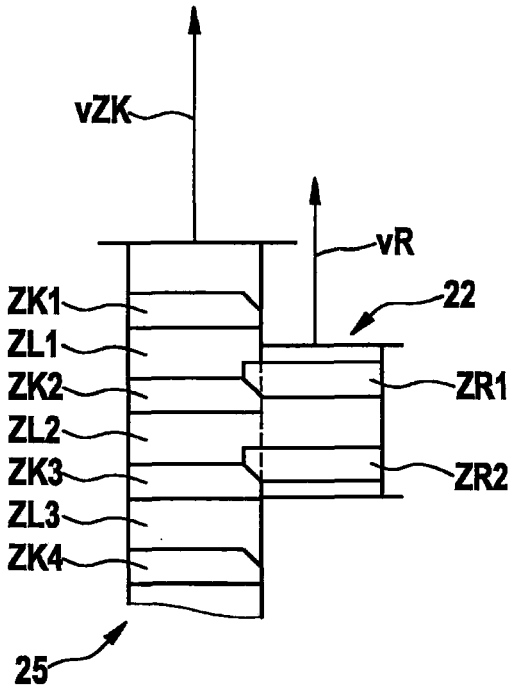
Figure 4E:
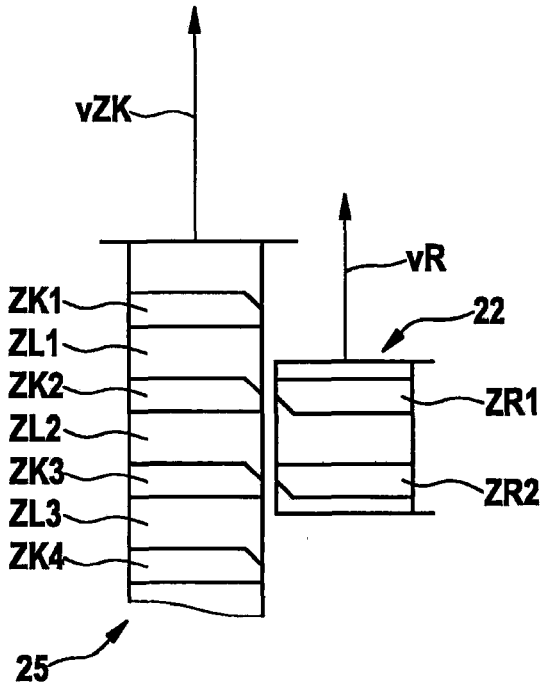
Figure 4F:
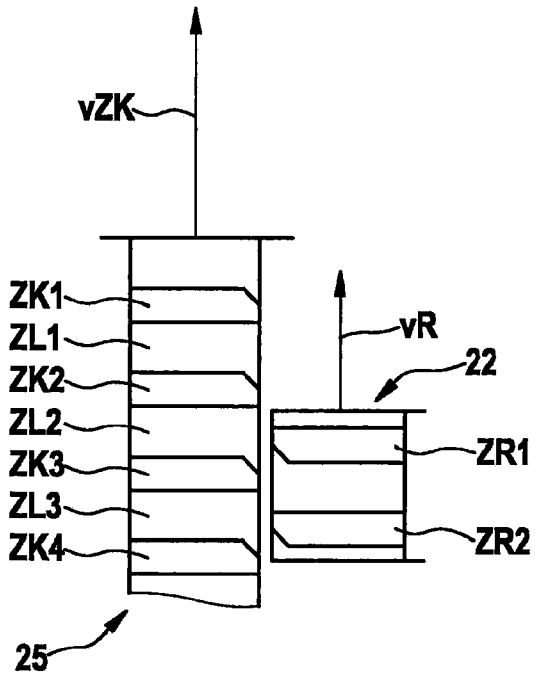
Figure 4G:
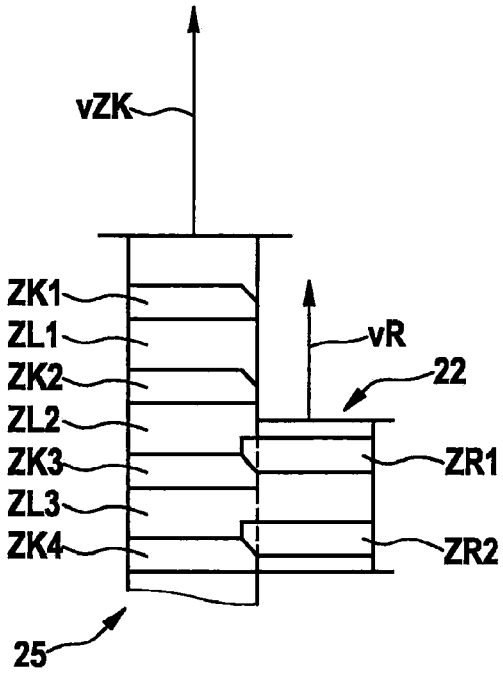

FIG. 4*b* shows the next step based on FIG. 4*a*. FIG. 4*b* shows here the moment when starting pinion 22 makes contact with ring gear 25. This FIG. 4*b* shows the normal case of the initial attempt of starting pinion 22 to engage with ring gear 25 of an internal combustion engine, specifically the so-called tooth-on-tooth position. It is clearly evident from this diagram that front sides 300 and 306 of teeth ZR1 and ZR2 and teeth ZK1 and ZK2 are in each other's way. It is thus not possible for starting pinion 22 to engage with ring gear 25 smoothly and in an unimpeded manner.

Figure 4H:
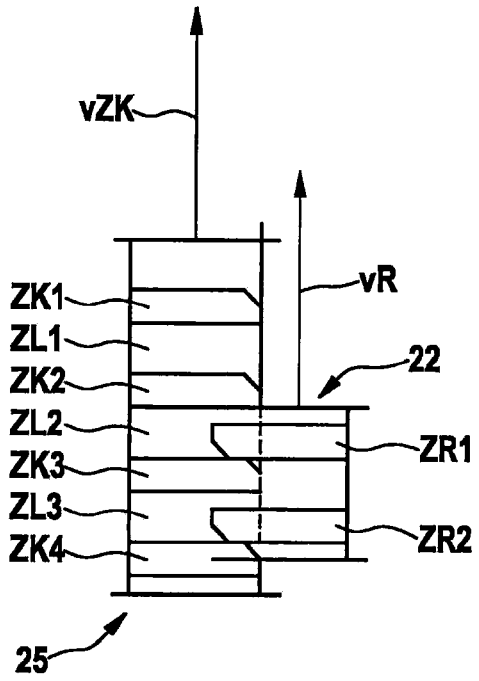

According to the further sequence of the pinion engaging method and the situation with respect to peripheral speeds $v_R$ and $v_{zK}$ of starting pinion 22 and ring gear 25, both gear wheels rotate in relation to one another. Consequently, teeth ZK1 and ZK2 of ring gear 25 slide along the front surfaces of teeth ZR1 and ZR2 until theoretically the possibility arises for teeth ZR1 and ZR2 to engage with a gap ZL1 between teeth ZK1 and ZK2. Due to the inertia of starting pinion 22 and the relative speed, i.e., the difference between the peripheral speeds of starting pinion 22 and ring gear 25, teeth ZR1 and ZR2 at first fail to engage with the appropriate gaps ZL1 and ZL2 of ring gear 25. Cants 303 of teeth ZR1 and ZR2 rather collide with cants 309 of teeth ZK2 and ZK3. This colliding or hitting results in that starting pinion 22 at first ricochets off cants 309, but loses kinetic energy in the process, i.e., is not pushed back too far in the axial direction (axis of rotation 276), see also FIG. 4*e*. During this colliding and not being engaged with ring gear 25, ring gear 25 rotates further in relation to starting pinion 22, so that cants 303 of teeth ZR1 and ZR2 are now facing cants 309 of teeth ZK3 and ZK4, see also FIG. 4*g*. The teeth of starting pinion 22 do not hit cants 309 of teeth ZK3 and ZK4 of ring gear 25 quite as hard, since the starting pinion now carries less kinetic energy. Furthermore, ring gear 25 has transferred a certain rotating impulse to starting pinion 22 as a result of the collision (FIG. 4*d*) of starting pinion 22 (however, resulting at the same time in a slight slow-down of the ring gear), so that starting pinion 22 does not ricochet or almost does not ricochet off cants 309 of teeth ZK3 and ZK4 with its own teeth ZR1 and ZR2, and based on a pre-tensioning force of spring 200 is pushed further into gaps ZL2 and ZL3 until these have left cants 309 of ring gear 25 behind (FIG. 4*h*).

Figure 4I:
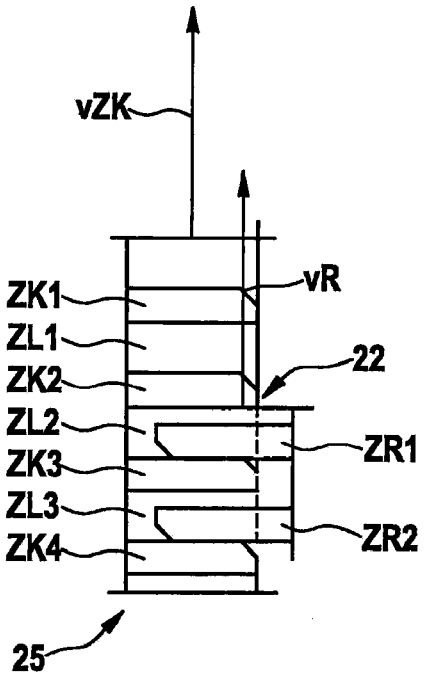
Figure 4J:
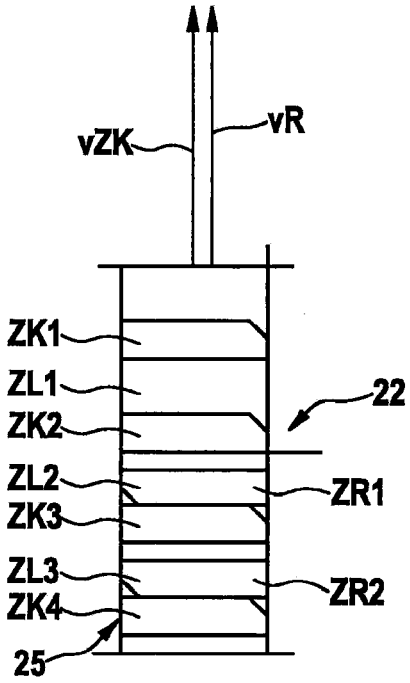
Figure 4K:
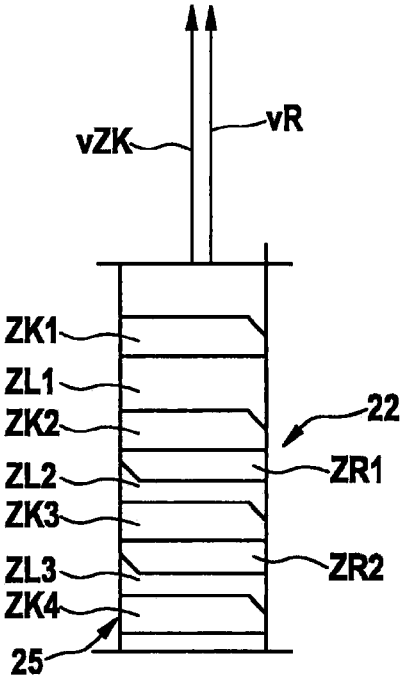

Teeth ZR1 and ZR2 of starting pinion 22 now slide further into gaps ZL3 and ZL2, now driven in the peripheral direction by ring gear or its teeth ZK3 and ZK4, until the teeth have been completely pushed into gaps ZL2 and ZL3 (FIG. 4*i* and FIG. 4*j*). Then, teeth ZR3 and ZR4 change their way of making contact (FIG. 4*k*), i.e., either ring gear 25 decelerates so much that teeth ZK3 and ZK4 slow down and make contact with teeth ZR1 and ZR2 or starting pinion 22 accelerates so much that it now actively drives ring gear 25 in order to restart internal combustion engine 20 via ring gear 25 (continuing operation of the internal combustion engine). The latter case may occur if the driver changes his or her mind, while starting pinion 22 is still engaging ring gear 25. Such a change may occur, for example, if the driver has come to a traffic light in his or her vehicle and actually intended to bring the vehicle to a standstill or has already brought it to a standstill for a very short time. In this case, the internal combustion engine may be in the process of slowing down, when the traffic light switches from "stop" to "go." In this case, by engaging a signaling unit, for example, which represents the intention of the driver (gas pedal), starting pinion 22 may suddenly be accelerated and the situation shown in FIG. 4*k* (key word "mind change") may occur.

According to what was previously described, a method for engaging a starting pinion 22 of a starting device 10 with a ring gear 25 of an internal combustion engine 20 is provided as a result, starting pinion 22 having a peripheral speed $v_R$ and ring gear 25 having a peripheral speed $v_{zK}$, starting pinion 22 being pushed forward axially along its axis of rotation 276, starting pinion 22 making contact with ring gear 25 at a peripheral speed $v_R$ which is lower than peripheral speed $v_{zK}$ of ring gear 25. This makes it clear that the speed ratios between starting pinion 22 and ring gear 25 are important for the method. Consequently, several cases are distinguished:

a) The first case is the case as shown in FIG. 3. Peripheral speed $v_{zK}$ of the ring gear is higher than peripheral speed $v_R$ of starting pinion 22. Conversely, this means that starting pinion 22 makes contact with ring gear 25 at a peripheral speed $v_R$ that is lower than peripheral speed $v_{zK}$ of ring gear 25. The direction of rotation is in this case the same as the intended or actual direction of rotation of a driving shaft 21 (e.g., a crankshaft) of internal combustion engine 20 when driving, and has here a positive value. In this case, peripheral speed $v_{zK}$ of ring gear 25 is not equal to zero. Peripheral speed $v_R$ of starting pinion 22 is not equal to zero either. Both peripheral speeds $v_R$, $v_{zK}$ are oriented in the same direction, FIG. 3.

b) In this case, peripheral speed $v_{zK}$ of ring gear 25 is again higher than peripheral speed $v_R$ of starting pinion 22. This means that the direction of rotation of starting pinion 22 is in this case opposed to the direction of rotation of starting pinion 22 from case a. Whereas in case a starting pinion 22 rotates with a rotation or angular velocity which is opposed to the intended rotation of driving shaft 21 when driving, in case b, the angular velocity of starting pinion 22, prior to making contact, is in the same direction as the subsequent angular velocity of driving shaft 21. With speed ratios of this type between ring gear 25 and starting pinion 22 the same relative movements may prevail as in case a. The difference with respect to case a is that, after engaging with starting pinion 22, the direction of rotation and thus the angular velocity of starter motor 13 is to be reversed.

c) In case c, peripheral speed $v_{zK}$ of ring gear 25 is greater than zero, and peripheral speed $v_R$ of starting pinion 22 is lower than peripheral speed $v_{zK}$ of ring gear 25. The angular velocity of ring gear 25 is opposed to the driving direction of rotation of driving shaft 21. A case of this type may occur when the direction of rotation of driving shaft 21 reverses in internal combustion engine 20 due to known slow-down properties. Thus the phenomenon that a piston, moving in an internal combustion engine to the so-called top dead center, compresses the air needed for combustion and thus works against the air pressure in the combustion chamber above the piston. If the energy of the piston or of driving shaft 21 and of the associated driving parts (piston, piston rod, crankshaft) is not high enough for the piston to move past the top dead center, driving shaft 21 will rotate back again. This case is meant in case c. In a situation of this type driving shaft 21 rotates back again, after not having reached the top dead center, and consequently has, for a short period of time, an angular velocity opposed to the angular velocity while driving and also to an angular velocity from case a. Details of this type in relation to this topic are generally known from publications about internal combustion engine technology. As soon as this angular velocity is reversed in its direction of rotation and thus assumes an angular velocity of driving shaft 21 and ring gear 25, this angular velocity and thus the peripheral speed of ring gear 25 has a negative value. In other words, the angular velocity of starting pinion 22 has, up to the point of contact, to assume a value that is even more negative than the value of the angular velocity of ring gear 25 in order to be lower than the angular velocity of ring gear 25 according to the definition presented here. According to the definition presented here, peripheral speed $v_R$ of starting pinion 22 is in this case also lower than peripheral speed $v_{zK}$ of ring gear 25.

It is provided in this method that, at the moment of initial contact, peripheral speed $v_{zK}$ of ring gear 25 is higher at most by a value formed by the product of 5 m/(s*mm) (five meters per product of seconds and millimeters) and module $m_{zK}$ of ring gear 25 in mm and is at least higher than peripheral speed $v_R$ of starting pinion 22. A value of 2.11 mm is taken here as an example for module $m_{zK}$ of ring gear 25. This technical variable, module m, is defined in the German industry standard DIN 868, for example, and is a basic parameter for measuring the length of toothings. Module m is a quotient obtained from dividing pitch p by the number π. Pitch p in turn is the arc on a reference surface between the flanks of two adjacent teeth carrying the same name, for example teeth ZK1 and ZK2, in a specific section of the toothing. If module m has the stated value, it is provided that peripheral speed $v_{zK}$ of ring gear 25 is at most 10.55 meters per second higher than peripheral speed y speed $v_R$ of starting pinion 22. For a module m of 3 mm, a value of 15 meters per second would be obtained, and for a module of 1.5 mm a speed of 7.5 meters per second.

It is furthermore provided that starting device 10 has a pinion shaft, which drives starting pinion 22, in the form of driver 131. A spring force of spring 200 acts on starting pinion 22, spring 200 being compressed during contact between starting pinion 22 and ring gear 25.

With reference to FIG. 2 it was already explained that a switching criterion, e.g., a speed of ring gear 25 or of driving shaft 21 or of a camshaft, is recognized by a control unit 273, implemented there as an engine control unit as apart of the method. Subsequently, starting pinion 22 is pushed forward toward ring gear 25 in one step and is set into rotation in another step, peripheral speed $v_R$ of starting pinion 22 when reaching ring gear 25 being lower than peripheral speed $v_{zK}$. It is initially irrelevant if starting pinion 22 is pushed forward prior to the start of rotation or vice versa.

A variant of the exemplary embodiment according to FIG. 2 may, for example, provide that a switching criterion such as the speed is not recognized by control unit 273 of internal combustion engine 20, but rather by control unit 250 of the starter, for example, which then subsequently induces the steps previously mentioned (setting into rotation, pushing forward).

The switching criterion may, for example, be a signal which generally corresponds to an intention to switch off the internal combustion engine. An intention of this type may become already apparent, for example, when the speed of the vehicle is to be reduced. A speed reduction of this type may, for example, result from operating the brake pedal or triggering an appropriate signal receiver which processes the signals of the brake system. Another appropriate signal could also be the signal that is provided to signal to internal combustion engine 20 that it is now supposed to be operated in overrun operation (overrun shutdown).

Thus, according to the method or a variant of this method it is provided that a point in time at which the starting device is activated is calculated based on the switching criterion in order to meet the conditions intended according to the exemplary embodiments and/or exemplary methods of the present invention. It is provided that the method is applied on an internal combustion engine 20 that is slowing down, the speed of driving shaft 21 being reduced. According to a further step of the method it is provided that the speed of starting pinion 22 is reduced to the value zero after engaging ring gear 25. Subsequently, the same condition also applies to ring gear 25.

It is provided as part of the method to activate starter motor 13 and stroker 186 separately from each other.

Spring 200 may be implemented as a helical spring or a spring plate or another type of spring, for example.

What is claimed is:

1. A method for engaging a starting pinion of a starting device with a ring gear of an internal combustion engine having a driving shaft, the method comprising:

providing a peripheral speed to a starting pinion;

providing a peripheral speed to a ring gear; and pushing forward the starting pinion axially along its axis of rotation, so that the starting pinion makes contact with the ring gear at a peripheral speed which is lower than the peripheral speed of the ring gear;

wherein an angular velocity of the ring gear is opposed to a driving direction of rotation of the driving shaft and thus has a negative value, and an angular velocity of the starting pinion is opposed to the angular velocity of the ring gear.

2. The method of claim 1, wherein the peripheral speed of the starting pinion is unequal to zero.

3. The method of claim 1, wherein the peripheral speeds are oriented in the same direction.

4. The method of claim 1, wherein the peripheral speed of the ring gear at the moment of initial contact is higher at most by a value formed by the product of 5 meters per second per millimeter and module m of the ring gear in mm and is at least higher than the peripheral speed of the starting pinion.

5. The method of claim 1, wherein the starting device has a pinion shaft which drives the starting pinion, wherein a spring force of a spring acts on the starting pinion, and wherein the spring is compressed during contact between the starting pinion and the ring gear.

6. The method of claim 1, wherein a switching criterion is recognized by a control unit and the starting pinion is pushed forward toward the ring gear in one step and is set into rotation in another step, and wherein the peripheral speed of the starting pinion when reaching the ring gear is lower than the peripheral speed of the ring gear.

7. The method of claim 6, wherein the switching criterion is a signal which corresponds to an intention to switch off the internal combustion engine.

8. The method of claim 6, wherein a point in time at which the starting device is activated is calculated based on the switching criterion.

9. The method of claim 6, wherein the starting pinion is first set into rotation in one step and then pushed forward to the ring gear in one step.

10. The method of claim 1, wherein a speed of the ring gear is essentially reduced.

11. The method of claim 1, wherein the starter motor and a stroker are activated separately from each other.

12. The method of claim 1, wherein the starting pinion has teeth having front sides and the ring gear has teeth having front sides, the starting pinion teeth having cants and the ring gear teeth having cants, the cants of the teeth of the starting pinion and the cants of the teeth of the ring gear facing each other.

13. The method of claim 12, wherein during the initial pinion engaging attempt a so-called tooth-on-tooth position occurs, then the teeth of the ring gear slide along the front sides of the teeth of the starting pinion until the teeth of the starting pinion are engage-able with a gap between the teeth of the ring gear, then the cants of the teeth of the starting pinion collide with the cants of the teeth of the ring gear and the starting pinion first ricochets off the cants, but loses kinetic energy in the process, and is pushed back toward the axis of rotation, the ring gear rotates further in relation to the starting pinion, so that the cants of the teeth of the starting pinion now face the cants of the teeth of the ring gear, the teeth of the starting pinion not colliding as hard with the cants of the teeth of the ring gear as the collision between the cants of the pinion and the cants of the ring gear, the ring gear transfers a certain rotating impulse to the starting pinion as a result of the collision of the starting pinion, so that the starting pinion does not ricochet or almost does not ricochet off the cants of the teeth with its own teeth and that due to a pre-tensioning force of a spring the starting pinion is pushed further into the gaps, until they have left the cants of the ring gear behind.

14. The method of claim 7, wherein the intention to switch off the internal combustion engine exists when at least one of a vehicle speed is zero, a drivetrain is open, and the vehicle speed is below a low speed threshold.

15. The method of claim 6, wherein the peripheral speed of the starting pinion is unequal to zero.

16. The method of claim 6, wherein the peripheral speeds are oriented in the same direction.

* * * * *